United States Patent [19]

Hollingworth

[11] 4,154,483

[45] May 15, 1979

[54] MINERAL CUTTING PICKS

[75] Inventor: Keith J. Hollingworth, Sheffield, England

[73] Assignee: Hall & Pickles Limited, Sheffield, England

[21] Appl. No.: 850,627

[22] Filed: Nov. 11, 1977

[30] Foreign Application Priority Data

Apr. 1, 1977 [GB] United Kingdom ..... 13824/77

[51] Int. Cl.[2] ..... E21C 25/46

[52] U.S. Cl. ..... 299/92; 37/142 A

[58] Field of Search ..... 299/92; 37/142 A; 85/83; 407/109

[56] References Cited

U.S. PATENT DOCUMENTS

| | | | |
|---|---|---|---|
| 3,466,772 | 9/1969 | Phillips | 299/92 X |
| 3,665,623 | 5/1972 | White | 299/92 X |
| 3,864,854 | 2/1975 | Evans | 37/142 A |
| 4,026,605 | 5/1977 | Emmerich | 299/92 |

FOREIGN PATENT DOCUMENTS

| | | | |
|---|---|---|---|
| 1243606 | 7/1967 | Fed. Rep. of Germany | 299/92 |

*Primary Examiner*—Ernest R. Purser

*Attorney, Agent, or Firm*—Lowe, King, Price & Becker

[57] ABSTRACT

A mineral cutting pick of the type having a non-circular shank extending from a body for fitting non-rotatably in a socket in a pick box, the shank being recessed adjacent the end remote from the body and housing therein resilient means with projections extending from opposite sides of the shank, the projections being provided with lead-in surfaces adjacent the end of the shank remote from the body, whereby when the end of the shank remote from the body is pushed into the socket in a pick box the projections are depressed sufficiently to enable the shank to be inserted fully into the box, and part of one or both projections may spring into a cutaway extending from one or both sides of the socket at the end of the pick box remote from the body of the pick inserted therein.

5 Claims, 16 Drawing Figures

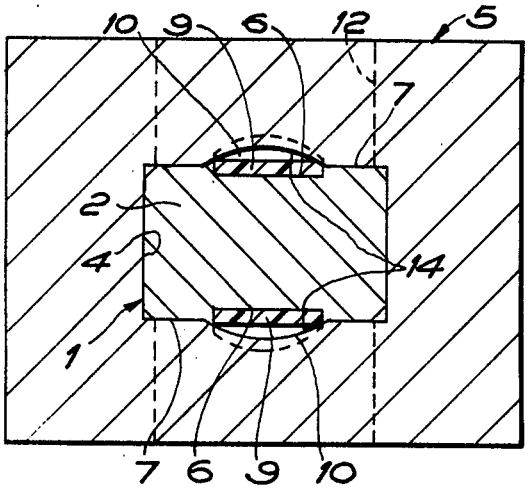
FIG. 6
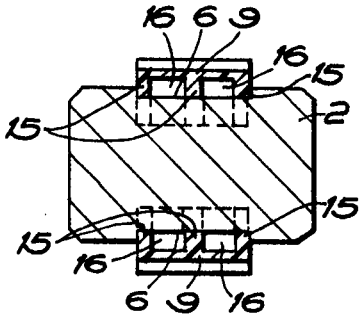
FIG. 7
FIG. 8
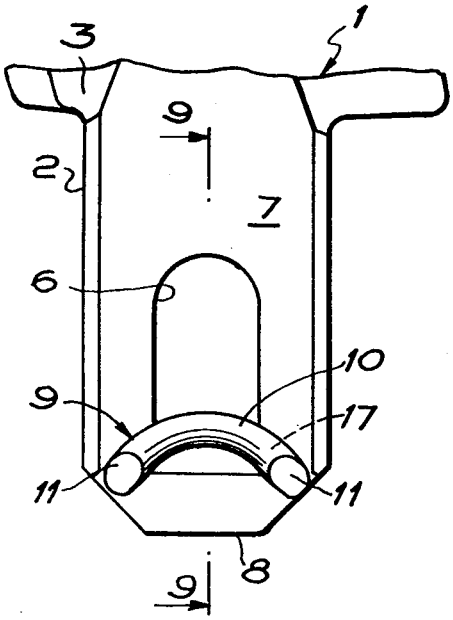
FIG. 9
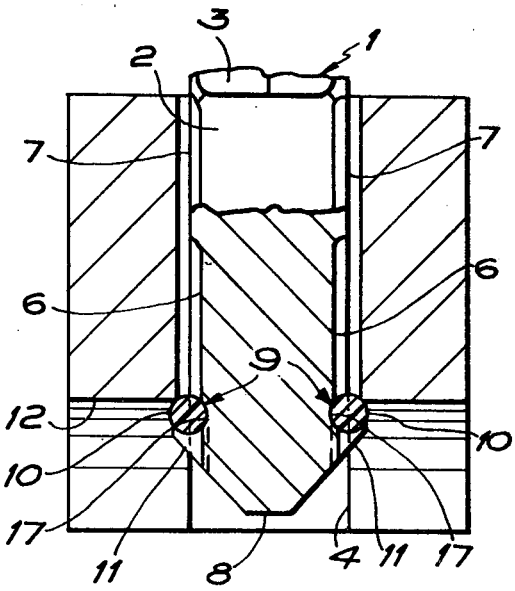

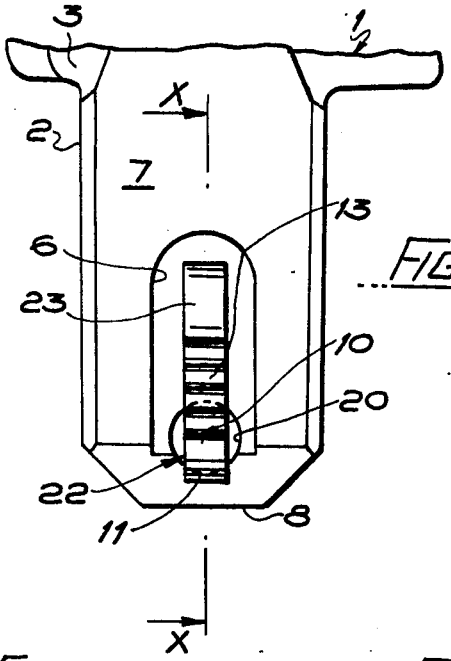
FIG. 14
FIG. 15
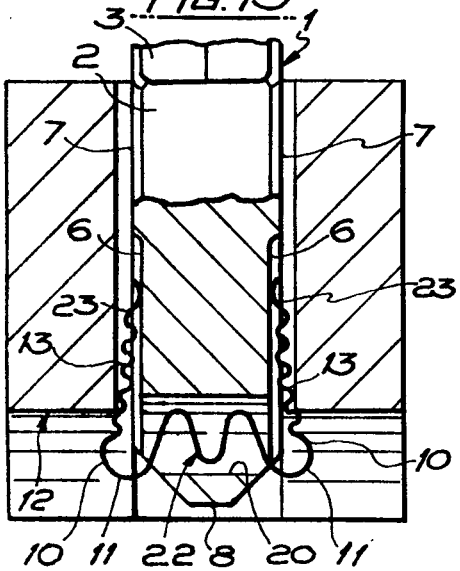
FIG. 16
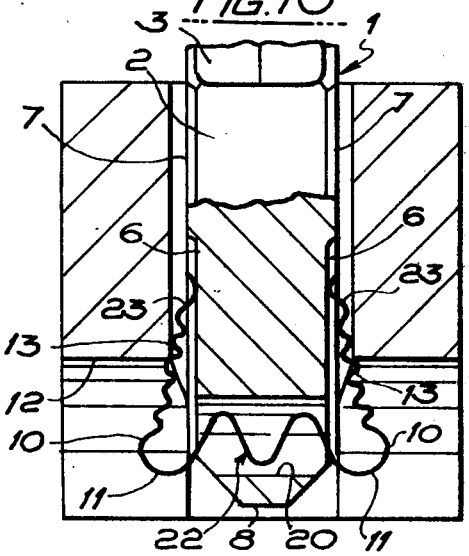

MINERAL CUTTING PICKS

This invention relates to mineral cutting picks (sometimes referred to as mining tools) and is concerned with such picks of the type having a non-circular shank extending from a body for fitting non-rotatably in a socket in a pick box (or toolholder) on a cutter drum or head and which may have one or more slots or holes for a locking device for securing the shank.

Frequently, when such a pick box becomes damaged, usually as the result of damage to a pick secured therein, the pick box is no longer capable of securing a pick shank in the socket and so necessitates changing of the whole drum or head.

The object of the invention is to provide a mineral cutting pick of the type referred to with means for securing it in a pick box of the type referred to without needing to use any slot or hole in the box.

According to the present invention, a mineral cutting pick of the type referred to has its shank recessed adjacent the end remote from the body and houses therein resilient means with projections extending from opposite sides of the shank, the projections being provided with lead-in surfaces adjacent the end of the shank remote from the body, whereby when the end of the shank remote from the body is pushed into the socket in a pick box the projections are depressed sufficiently to enable the shank to be inserted fully into the box.

The projections may secure the shank in the socket solely by frictional grip against the socket under the urge of the resilient means, but the provision of the resilient means with projections adjacent to the end of the shank remote from the body enables the pick to be used to advantage in a pick box of the type having a cutaway extending from the socket at the end remote from the body of a pick inserted therein to facilitate extraction of broken shanks, by springing of part of one of the projections into the cutaway, if extending from one side only of the socket, or by springing of parts of both projections into the cutaway, if extending from both sides of the socket. The projections may be provided with toothed or stepped surfaces following on from the lead-in surfaces, for effecting engagement of one tooth or step on the or each projection with the intersection or intersections of the cutaway and the socket, and the teeth or steps may be curved concave towards the end of the shank remote from the body, for matching a curved cutaway in a box. Advantage is also gained with a box having its socket provided with shallow (e.g. concave) grooves extending along two opposite sides, in that projections aligned with the grooves do not have to be depressed into the recessed shank in order for the latter to be inserted fully into the socket.

The end of the pick shank remote from the body may be bevelled, to assist initial entry of the shank into the socket in a pick box.

The resilient means may consist of a strip of spring steel housed in a lateral recess through the shank, with loops projecting from each end of the recess and bent back into gripping engagement with the sides of the shank, preferably within shallow grooves in the shank extending from the recess. Alternatively, the resilient means may consist of one or more compression springs (which may be formed of plastics material) e.g. polyurethane, housed in a lateral recess through the shank, with separate members projecting from each end of the recess. Again the resilient means may consist of a pair of resilient plastics members bonded in recesses on opposite sides of the shank, with portions of the resilient plastics members projecting from the recesses.

A number of embodiments of the invention will now be described, by way of example only, with reference to the accompanying drawings, in which FIG. 1 is a side elevation of a mineral cutting pick in accordance with the invention;

Figure 1:
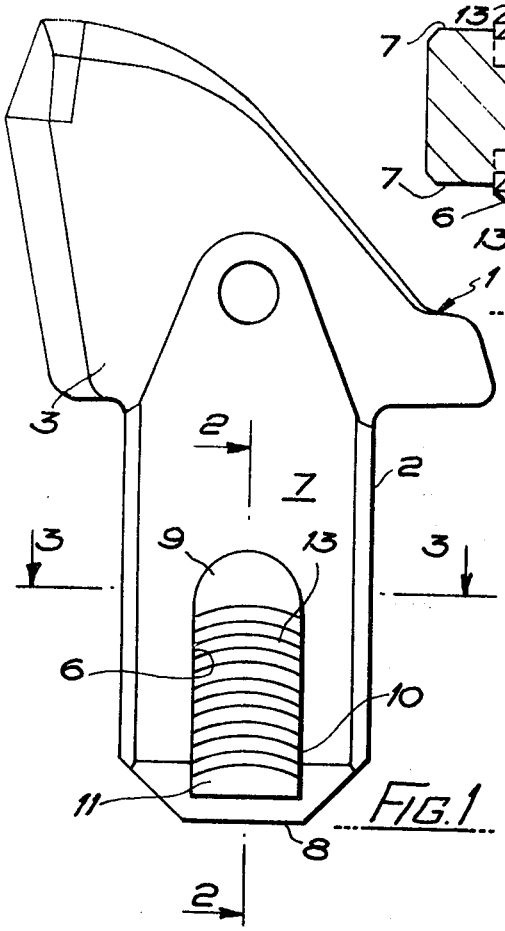
Figure 3:
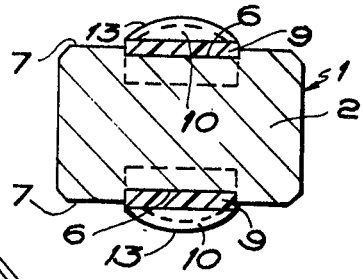
FIG. 3 is a section on the line 3—3 of FIG. 1.
Figure 2:
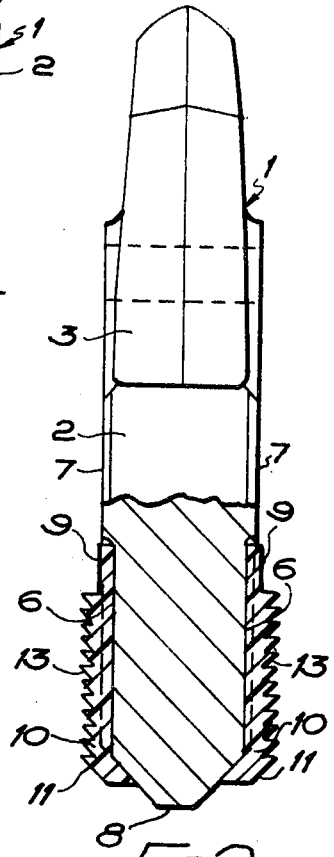
FIG. 2 is a front elevation partially in section on the line 2—2 of FIG. 1.
Figure 4:
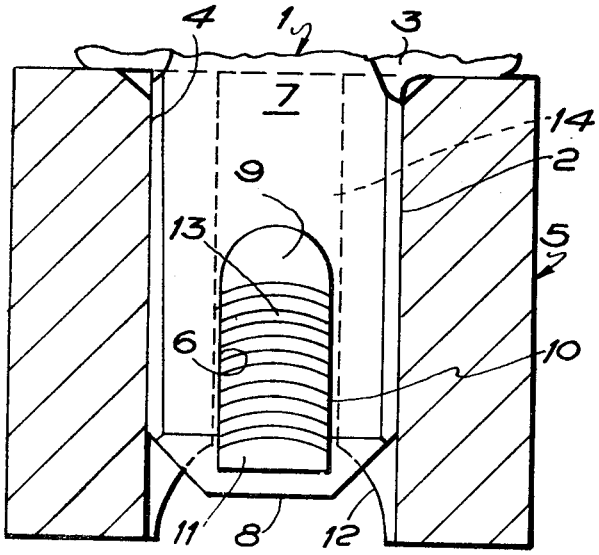
Figure 5:
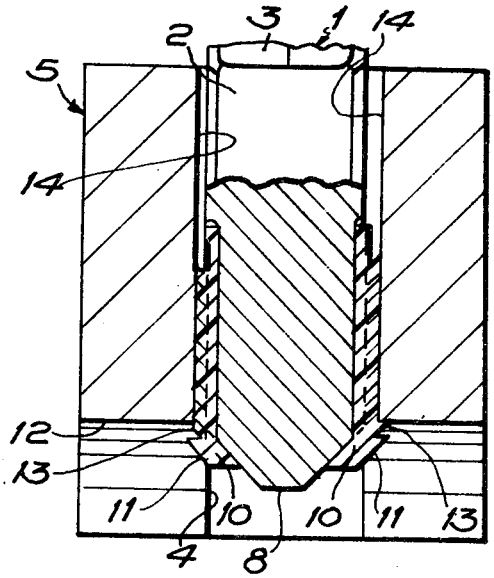

FIGS. 4 to 6 correspond respectively to the lower parts of FIGS. 1 and 2 and to FIG. 3 but show the pick mounted in a pick box of the type having a cutaway extending from the socket at the end remote from the body of the pick;

FIG. 7 corresponds to FIG. 3 but shows a modification;

FIG. 8 corresponds to the lower part of FIG. 1 but illustrates another form of pick according to the invention;

FIG. 9 is a fragmentary section on the line 9—9 of FIG. 8 showing the pick mounted in a box;

FIGS. 10 and 11 and FIGS. 12 and 13 correspond to FIGS. 8 and 9 but illustrate two further embodiments of pick according to the invention;

FIG. 14 corresponds to FIG. 8 but illustrates yet another embodiment of pick according to the invention; and FIGS. 15 and 16 are sections on the line X—X of FIG. 14 showing the pick of FIG. 14 mounted in pickboxes with different sizes of cutaway extending from the socket at the end remote from the body of the pick.

In FIGS. 1 to 6 a mineral cutting pick 1, having a non-circular shank 2 extending from a body 3 for fitting non-rotatably in a socket 4 in a pick box 5, has its shank recessed at 6 at each side 7 adjacent the end 8 remote from the body and houses therein resilient members 9 (bonded in the recesses) with projections 10 extending from the sides of the shank, the projections being provided with lead-in surfaces 11 adjacent the end 8 of the shank, whereby when that end of the shank is pushed into the socket 4 in the pick box 5 the projections are depressed sufficiently to enable the shank to be fully inserted into the box.

Although the projections 10 could secure the shank 2 in the socket 4 solely by frictional grip, the provision of the resilient members 9 adjacent the end 8 of the shank enables the pick 1 to take advantage of a cutaway 12 extending from the socket at the end remote from the body 3 (which cutaway facilitates extraction of broken shanks) by springing of parts of both projections into the cutaway. If, however, the cutaway were to extend from one side only of the socket—as is sometimes the case—then a part of only one of the projections could spring into the cutaway, and the other projection would remain depressed by the remaining socket wall opposite the cutaway.

The projections 10 are provided with toothed surfaces 13 following on from the lead-in surfaces 11 for effecting engagement of one tooth on each projection with the intersections of the cutaway 12 and the socket 4, and the teeth are curved concave towards the end 8 of the shank, for matching the curved cutaway in the box 5. Advantage is also gained from shallow concave grooves 14 extending along the two opposite sides of the socket 4 corresponding to the sides 7 of the shank 2, in that the projections 10 do not have to be depressed into the recesses 6 in order for the shank to be inserted fully into the socket.

The end 8 of the shank 2 is bevelled, to assist initial entry of the shank into the socket 4 in the pick box 5.

In FIG. 7, showing a modification of FIG. 3, the resilient members 9 are formed with ribs 15 which are bonded to the recesses 6 to form spaces 16 increasing the resilience of the memebers 9.

In FIGS. 8 to 16 the pick shanks 2 and the pick boxes 5 have the same basic shapes as in FIGS. 1 to 6, and so like reference numerals represent like parts. However, in FIGS. 8 to 16 the recesses 6 no longer house (or only very partially house) the resilient members (or resilient means) and, therefore, will be referred to—where necessary—merely as grooves 6.

In FIGS. 8 and 9 resilient members 9 are formed of lengths of round-section resilient material (e.g., synthetic rubber) bonded in arcuate grooves 17 across the sides 7 of the shank 2 concave to the end 8 to match the curved cutaway 12 in the box 5, and the ends of the resilient members are cut oblique in continuation of the bevelling of the sides of the end 8 of the shank to provide lead-in surfaces 11 to projecting portions 10 of the resilient members.

Figure 10:
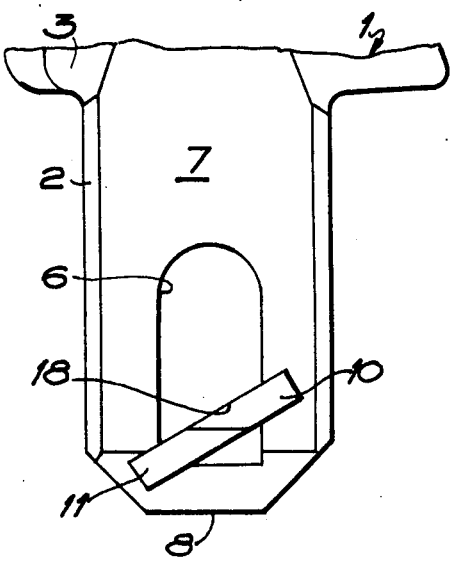
Figure 11:
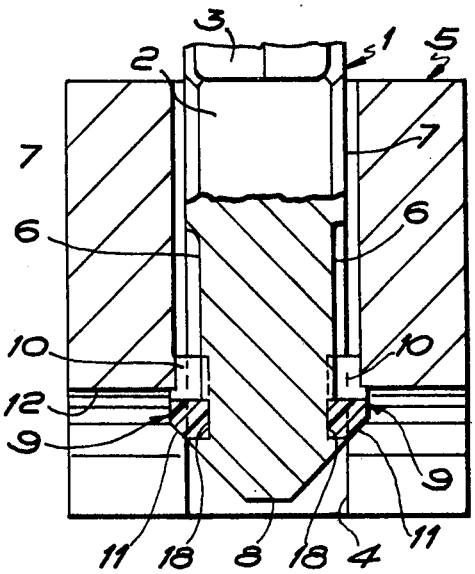

In FIGS. 10 and 11 resilient members 9 are formed of lengths of rectangular-section resilient material bonded in grooves 18 inclined across the sides 7 of the shank 2, and the ends adjacent the end 8 of the shank are cut oblique in continuation of the bevelling of the sides of the end 8 of the shank to provide lead-in surfaces 11 to projecting portions 10 of the resilient members which intersect with the intersections between the socket 4 and the cutaway 12 in the box 5.

Figure 12:
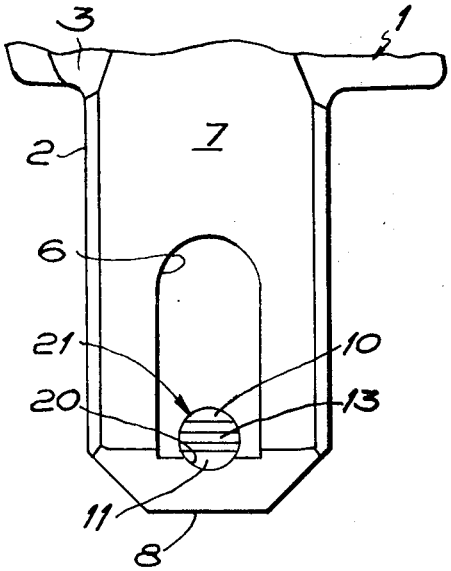
Figure 13:
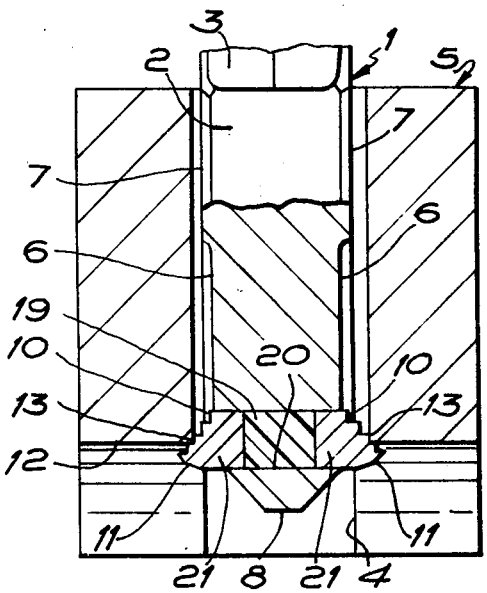

In FIGS. 12 and 13 resilient means consists of a compression spring 19 of plastics material, e.g., polyurethane, is housed in a lateral recess 20 through the shank 2, with separate members 21 bonded to the spring and portions 10 projecting from each end of the recess, and with lead-in surfaces 11 followed by stepped surfaces 13 enabling one step on each member to engage with the intersections between the socket 4 and the cutaway 12 in the box 5.

In FIGS. 14 to 16 resilient means consists of a strip 22 of spring steel housed in a lateral recess 20 through the shank 2, with loops 23 bent back into gripping engagement with the sides of the shank within the grooves 6 of the shank, and with lead-in surfaces 11 on the loops 23 followed by stepped surfaces 13 (formed by corrigations) enabling one step on each loop to engage with the intersections between the socket 4 and the cutaway 12 in the box 5.

What I claim is:

1. A mineral cutting pick having a non-circular shank extending from a body for fitting non-rotatably in a socket in a pick box, the shank being recessed adjacent the end remote from the body and housing therein resilient means with projections extending from opposite sides of the shank, each projection being provided with a lead-in surface adjacent the end of the shank remote from the body and at least one step following on from the lead-in surface, each step being curved concave towards the end of the shank remote from the body, whereby when the end of the shank remote from the body is pushed into the socket in a pick box the projections are depressed sufficiently to enable the shank to be inserted fully into the box.

2. A pick as in claim 1, which includes a plurality of steps on each projection curved concave toward the remote end of the shank.

3. A pick as in claim 2, wherein one of the curved steps on each projection is engageable with the matching edge of a curved cutaway in the box.

4. A pick as in claim 1, wherein the end of the pick shank remote from the body is bevelled.

5. A pick as in claim 1, wherein the resilient means consists of a pair of resilient plastics members bonded in recesses on opposite sides of the shank, with portions of the resilient plastics members projecting from the recesses.

* * * * *